US006893690B2

(12) United States Patent
Yamamoto

(10) Patent No.: US 6,893,690 B2
(45) Date of Patent: May 17, 2005

(54) INK JET RECORDING SHEET

(75) Inventor: Hirotaka Yamamoto, Shizuoka (JP)

(73) Assignee: Nisshinbo Industries, Inc., Tokyo (JP)

( * ) Notice: Subject to any disclaimer, the term of this patent is extended or adjusted under 35 U.S.C. 154(b) by 0 days.

(21) Appl. No.: 09/941,666

(22) Filed: Aug. 30, 2001

(65) Prior Publication Data

US 2002/0048661 A1 Apr. 25, 2002

(30) Foreign Application Priority Data

Sep. 1, 2000 (JP) ..... 2000-265174
Dec. 6, 2000 (JP) ..... 2000-371276

(51) Int. Cl.[7] ..... B41M 5/40
(52) U.S. Cl. ..... 428/32.28; 428/32.3; 428/32.35
(58) Field of Search ..... 428/32.28, 32.3, 428/32.35, 195, 206, 323, 328, 500, 32.34

(56) References Cited

U.S. PATENT DOCUMENTS 5,882,755 A * 3/1999 Igarashi et al. ..... 428/41.8
5,989,378 A * 11/1999 Liu et al. ..... 156/241
6,110,601 A * 8/2000 Shaw-Klein et al. ..... 428/522
6,140,406 A * 10/2000 Schliesman et al. ..... 524/493
6,165,606 A * 12/2000 Kasahara et al. ..... 428/323
6,197,381 B1 * 3/2001 Saito et al. ..... 427/374.3
6,242,082 B1 * 6/2001 Mukoyoshi et al. ..... 428/212
6,277,498 B1 * 8/2001 Endo et al. ..... 428/500
6,312,794 B1 * 11/2001 Sekiguchi et al. ..... 428/318.4
6,326,075 B1 * 12/2001 Nagasaki et al. ..... 428/195
6,372,329 B1 * 4/2002 Graczyk et al. ..... 428/195
6,436,513 B1 * 8/2002 Kitamura et al. ..... 428/195
6,502,935 B1 * 1/2003 Barcock et al. ..... 347/105

FOREIGN PATENT DOCUMENTS

JP 07-125412 5/1995

* cited by examiner

*Primary Examiner*—B. Shewareged
(74) *Attorney, Agent, or Firm*—Westerman, Hattori, Daniels & Adrian, LLP

(57) ABSTRACT

Provided is an ink jet recording sheet suitable for outdoor use, the recording sheet giving rise to no blurring of an image, being provided with an ink receiving layer and a print portion having high water-resistance and excellent abrasive resistance in a wet condition while maintaining color developing ability and ink-fixing ability and having excellent color reproducibility and light resistance. The ink jet recording sheet comprises an ink receiving layer disposed on a substrate, said ink receiving layer being formed by preparing a layer containing a porous filler and a binder by application and drying on the substrate and thereafter allowing the layer to be impregnated with a water-soluble cationic organic material, wherein said layer containing the porous filler and the binder is formed using a coating liquid having a pH of 4 or less, the amount of the water-soluble cationic organic material contained in said layer containing the porous filler and the binder after the layer is impregnated with the water-soluble cationic organic material is 2% by weight or less in terms of solid ratio to the layer and said filler is contained in an amount of 40 to 80% by weight in the total solid of the ink receiving layer.

5 Claims, No Drawings

INK JET RECORDING SHEET

BACKGROUND OF THE INVENTION

1. Field of the Invention

The present invention relates to an ink jet recording sheet suitable for outdoor use, the recording sheet giving rise to no blurring of an image, being provided with an ink receiving layer and a print portion having high water-resistance and excellent abrasive resistance in a wet condition while maintaining color developing ability and ink-fixing ability and having excellent color reproducibility and light resistance.

2. Description of the Related Art

As ink jet recording sheets, various types have been proposed and put to practical use. Ink used for recording in a recording material of an ink jet recording sheet is anionic in general. Therefore, methods are being used in which a cationic organic material is contained in the recording material to improve resistance to ink-blurring, color developing ability and ink-fixing ability. The recording sheet is made so often to contain, particularly, a quaternary ammonium salt, dicyandiamide type, polyamine type or alkylamine type water-soluble cationic organic material and often uses, as a binder, polyvinyl alcohol or a resin containing the polyvinyl alcohol as its major component together.

A poster use is among the major uses of ink jet recording sheets. Particularly, posters for outdoor use sometimes come in contact with other materials in the condition that they are wet with rain or the like during a posted period and fitting works and therefore abrasive resistance in a wet condition is required. However, ink jet recording sheets in the above prior art are unsatisfactory in this point. If, particularly, the aforementioned water-soluble cationic organic material is added, the abrasive resistance of a coating layer in a wet condition is considerably decreased. Also, if polyvinyl alcohol or a binder resin containing polyvinyl alcohol as its major component is used as a binder, the abrasive resistance of a coating layer in a wet condition is decreased. In the case of using a cationic organic material together, the reduction is made significant.

SUMMARY OF THE INVENTION

In view of the aforementioned prior art problems, it is an object of the present invention to provide an ink jet recording sheet suitable for outdoor use, the recording sheet giving rise to no blurring of an image, being provided with an ink receiving layer and a print portion having high water-resistance and excellent abrasive resistance in a wet condition while maintaining color developing ability and ink-fixing ability and having excellent color reproducibility and light resistance.

An ink jet recording sheet according to the present invention made with the intention to solve the above problems has a structure in which an ink receiving layer is provided on a substrate, the ink receiving layer being formed by preparing a layer containing a porous filler and a binder by coating and drying on the substrate and thereafter allowing the layer to be impregnated with a water-soluble cationic organic material, wherein the layer containing the porous filler and the binder is formed using a coating liquid having a pH of 4 or less;

the amount of the water-soluble cationic organic material contained in the layer containing the above porous filler and binder after the layer is impregnated with the water-soluble cationic organic material is 2% by weight or less in terms of solid ratio to the layer; and the above filler is contained in an amount of 40 to 80% by weight in the total solid of the ink receiving layer.

Specifically, the inventors of the present invention have repeated earnest studies for the purpose of improving the abrasive resistance of an ink jet recording sheet in a wet condition and, as a result, found that;

(1) unlike prior art, a coating liquid containing a water-soluble cationic organic material is not applied but a coating liquid comprising other components is applied and dried, and thereafter a small amount of a water-soluble cationic organic material is supplied from the above and in this case, the water-soluble cationic organic material is allowed to penetrate properly into the layer (layer containing a filler and a binder) formed first on the substrate;

(2) the use of a porous filler improves the effect; and (3) when the above porous filler is silica and silanol-modified polyvinyl alcohol is used together, the effect is further improved. The present invention was thus completed.

In addition, it is preferable that the layer be impregnated with the water-soluble cationic organic material such that the water-soluble cationic organic material is contained in a larger amount in the vicinity of the surface of an ink receiving layer.

Also, in the present invention, a higher effect can be produced by controlling the pH of the coating liquid used for the formation of the layer containing the porous filler and the binder. If the pH of the coating liquid is adjusted to 4 or less, it improves the effect of suppressing ink-blurring. This renders it possible to further decrease the amount of the water-soluble cationic organic material in the ink receiving layer. In the case where the pH of the coating liquid is adjusted to 4 or less, the amount of the water-soluble cationic organic material in the ink receiving layer is reduced to 2% by weight or less in terms of solid ratio to the layer. The blurring can be sufficiently suppressed even in such a small amount. The ink receiving layer and the print portion are more improved in water-resistance and abrasive resistance in a wet condition by decreasing the amount of the water-soluble cationic organic material in the ink receiving layer. Also, in this case, the effect of suppressing blurring by, particularly, pigment type ink is remarkably improved. It is to be noted that the pH of the coating liquid can be adjusted to 4 or less by adding a material having a lower pH. Examples of the material to be added include colloidal silica of a type having a lower pH, acetic acid, sulfuric acid, hydrochloric acid and nitric acid.

Moreover, in the case where the above porous filler is silica, silica is preferably made to be present in an amount ranging between 40 to 80% by weight in the total solid of the ink receiving layer to fulfill the requirements as to ink-absorbing ability and abrasive resistance in a wet condition. It is preferable to use silica having an average particle diameter of 5 $\mu$m or less when measured using a coulter counter method and an oil absorptiveness of 200 to 230 ml/100 g.

Further, silica having a larger average particle diameter than the above silica may be mixed with the above silica upon use to improve the ink-absorbing ability of the coating layer. As the silica in this case, one having an average particle diameter of 10 $\mu$m or more is preferable. The mixing ratio of the above silica to the silica having a larger average particle diameter than the above silica is preferably 100:0 to 50:50. When the ratio of the silica having a larger particle diameter is higher than the above range, the surface roughness of the coating layer is increased and the adhesive strength of the coating layer is reduced, with the result that the abrasive resistance in a wet condition tends to be decreased.

Moreover, as the binder, one containing silanol-modified polyvinyl alcohol is preferable. If the above silica and this silanol-modified polyvinyl alcohol are used together, the effect is significantly improved.

In addition, the above water-soluble cationic organic material with which the layer is impregnated is preferably a dicyandiamide condensate. Also, a structure may be adopted in which the ink receiving layer contains a hydrate aluminum oxide and further a water-soluble aluminum salt.

Incidentally, the inventors of the present invention infer the reason why the above effects are obtained as follows.

(1) In the case of the production method in prior art, the water-soluble cationic organic material is contained in a portion (primarily comprising a binder) which bonds the fillers with each other. The water-soluble cationic organic material has inferior water-resistance. Therefore, if it is contained in the bonding portion, the abrasive resistance of the whole layer in a wet condition is low. On the contrary, in the present invention, the water-soluble cationic organic material is supplied after the bonding portion is dried and solidified and therefore the water-soluble cationic organic material is not contained in the bonding portion.

Also, in the case of the prior art production method, the water-soluble cationic organic material is uniformly distributed. On the other hand, in the case of the present invention, the water-soluble cationic organic material is supplied from the above of the formed layer. A large proportion of the organic material therefore remains at a place relatively close to the surface although the organic material penetrates into the layer. Accordingly, even a small amount of the organic material is enough to maintain the same effects as to ink-blurring characteristics, color developing ability and fixing ability. Therefore, only a small ratio of the water-soluble cationic organic material in the whole coating layer is required, leading to excellent water-resistance. When the water-soluble cationic organic material does not almost penetrate but remains on the surface on the contrary, the water-resistance of the surface is inferior. However, the present invention is also free from such a phenomenon.

(2) If a layer formed first contains a porous filler, the water-soluble cationic organic material which is supplied afterwards is absorbed in the pore portion of the porous filler. Such a structure gives the water-soluble cationic organic material reduced chances to be brought into contact with water when an ink jet recording sheet is wetted. For this, the abrasive resistance in a wet condition is improved. In the case of the conventional production method, even if a porous filler is used, a little space remains to absorb the water-soluble cationic organic material because the pores in the coating liquid have absorbed water.

(3) Silica is bound strongly with silanol-modified polyvinyl alcohol to form a firm layer, which contributes to an improvement in abrasive resistance in a wet condition.

DETAILED DESCRIPTION OF THE PREFERRED EMBODIMENTS

Next, an embodiment of an ink jet recording sheet according to the present invention will be explained. First, as a substrate in the ink jet recording sheet of the present invention, paper or a plastic film is used. As the paper, wood free paper, wood containing paper, woody paper, simili, art paper, ultra lightweight coat paper, tissue paper, chemical pulp paper or fancy paper is used. As the plastic film, a general thermoplastic resin film such as a polyethylene terephthalate film, polypropylene film, polystyrene film or polycarbonate film or a foam film of each of these thermoplastic resin films to which an inorganic powder such as calcium carbonate is internally added or white polyethylene terephthalate (PET) to which titanium oxide is internally added and which has surface glossiness is used.

The ink jet recording sheet of the present invention is obtained by disposing an ink receiving layer on the above substrate. When the ink receiving layer is formed, first a layer containing a porous filler and a binder is formed on the substrate. Examples of materials to be used for the porous filler include water-insoluble materials such as silica, calcium carbonate, magnesium carbonate, diatomaceous earth, talc, titanium oxide and alumina sol. These materials may be used either singly or in combinations of two or more. Silica is desirable as the porous filler in view of ink-absorbing ability. It is preferable that the above silica be made to be present in an amount ranging between 40 and 80% by weight in the total solid of the ink receiving layer to fulfill the requirements as to ink-absorbing ability and abrasive resistance in wet condition. Particularly, silica having an average diameter of 5 $\mu$m or less which is measured by a coulter counter method and an oil absorptiveness of 200 to 230 ml/100 g is preferably used. When the content of silica is less than 40% by weight, only insufficient ink-absorbing ability is obtained whereas when the content exceeds 80% by weight, the strength of the coating layer tends to be lowered.

Silica having a larger average diameter than the above silica may be used by mixing this silica with the above silica to further improve the ink-absorbing ability of the coating layer. The average particle diameter of the silica having a larger average diameter is preferably 10 $\mu$m or more. The mixing ratio of the above silica to the silica having a larger average diameter than the above silica is preferably 100:0 to 50:50. If the ratio of the silica having a larger average diameter is higher than the above range, the surface of the coating layer is made more coarse and the adhesive strength of the coating layer is decreased. Therefore the abrasive resistance in a wet condition tends to be decreased.

Given as examples of the binder resin are polyvinyl alcohol, polyvinylbutyral, gelatin, polyvinylacetal, carboxymethyl cellulose, polyvinylpyrrolidone, styrene/acryl copolymers, ethylene/vinyl acetate copolymers, styrene/butadiene rubber, polyurethane resins and acrylic resins. These materials may be used either singly or by mixing them. Particularly, if silica is used as the filler and silanol-modified polyvinyl alcohol is used as the binder, the abrasive resistance in a wet condition is improved and it is therefore desirable. Among silanol-modified polyvinyl alcohol materials, particularly those having a saponification degree of 98% or more and a polymerization degree of 1000 or more are preferable.

Next, the ink receiving layer of the ink jet recording sheet of the present invention is formed by forming the layer containing the porous filler and the binder on the substrate, followed by drying and thereafter by allowing the layer to be impregnated with the water-soluble cationic organic material. Methods of impregnating with the water-soluble cationic organic material include a method in which an aqueous solution of the water-soluble cationic organic material is applied or sprayed and a method in which the layer containing the above porous filler and the binder is dipped in an aqueous solution of the water-soluble cationic organic material. Other methods may be used as far as the layer can be impregnated with the water-soluble cationic organic material. Here, the term "impregnation" implies the case where, as a result of the impregnation, the water-soluble cationic organic material is uniformly contained in the ink receiving layer or is contained in a larger amount in the vicinity of the surface of the ink receiving layer. It is to be noted that the case where the water-soluble cationic organic material is contained in a larger amount in the vicinity of the surface of the ink receiving layer includes the case where a layer containing the water-soluble cationic organic material is left partly on the surface of the layer containing the porous filler and the binder.

Given as examples of the water-soluble organic material are quaternary ammonium salts, dicyandiamide types, polyamine types and alkylamine types. Particularly dicyandiamide condensates are preferable in view of color-developing ability. In the present invention, the content of the water-soluble cationic organic material is 1.5 to 7.5% by weight and more preferably 2.0 to 5.0% by weight in the solid content of the ink receiving layer. The amount per unit area is 0.2 to 1.0 g/m$^2$ and more preferably 0.4 to 0.7 g/m$^2$. If the amount is excessively small, only insufficient ink-blurring characteristics, color-developing ability and ink-fixing ability are obtained. In conventional methods, an amount of about 11% by weight is required to produce sufficient effects concerning ink-blurring characteristics, color-developing ability, ink-fixing ability. In the present invention, on the contrary, the same effects are produced even if the amount is small. It is unnecessary to contain the same organic material in advance in the layer containing the porous filler and the binder before the water-soluble cationic organic material is supplied. It is desirable to exclude the organic material completely in view of water-resistance. Even in the case of containing the organic material for some purpose, an amount exceeding 2% by weight in the solid content of the layer gives rise to the problem concerning the abrasive resistance in a wet condition.

For the formation of the layer containing the porous filler and the binder and also for the supply of the water-soluble cationic organic material, conventionally known various methods such as coating, spraying and dipping may be used. It is preferable to use a coating method, particularly, reverse roll coating, air knife coating, gravure coating or blade coating. Also, an anchor layer may be formed to improve adhesion.

The water-soluble cationic organic material is usually supplied by dissolving it in a liquid. The concentration of the water-soluble cationic organic material in this case is 10% by weight or less and more preferably 5% by weight or less based on the liquid. When the concentration exceeds 10% by weight, the rate of penetration into the layer containing the porous filler and the binder is decreased so that the amount the cationic organic material left in the vicinity of the surface is excessively increased. As the above liquid, water may be used either singly or by mixing a water-soluble organic solvent therewith.

It is not preferable to contain the binder and the filler in the liquid (surface treating agent) in which the above water-soluble cationic organic material is dissolved. The reason is that, as to an influence on the ink receiving layer, if the binder is added, the strength of the ink receiving layer is increased whereas a reduction in the ink-absorbing ability of the ink receiving layer is easily caused and also, if the filler is added, the filler is not bonded to the coating layer but only enters a void portion in the coating layer, which easily causes the strength of the coating layer and abrasive resistance to decrease because the bonding power of the water-soluble cationic organic material is very weak. Further, if both the binder and the filler are added, it is highly possible to form a new layer, which causes ink to blur at the boundary and also causes an easy reduction in the strength of the ink receiving layer.

Also, it is not preferable that the above liquid (surface treating agent) contain the binder and the filler. The reason is as follows. Specifically, as to an influence on the distribution of the water-soluble cationic organic material in the ink receiving layer, if the binder is added, the binder is cured with a part of the water-soluble cationic organic material being incorporated into the binder. Therefore, the effect of the water-soluble cationic organic material in the ink receiving layer is not secured. For this, in order to obtain the same effect as the surface treating agent having no binder, it is necessary to increase the amount of the water-soluble cationic organic material. However, if the amount is increased, the distribution of the water-soluble cationic organic material in the ink receiving layer tends to become denser on the surface than as required, easily causing the ink receiving layer to be decreased in water-resistance and in abrasion resistance in a wet condition and the print portion to be decreased in water-resistance and in abrasive resistance in a wet condition. Also, if the binder is cured with the water-soluble cationic organic material being contained therein, the water resistance tends to be reduced, with the result that a reduction in the water-resistance of the ink receiving layer is easily caused. When the binder is, particularly, polyvinyl alcohol, the water-resistance is significantly decreased. Also, when the filler is added, a part of the water-soluble cationic organic material is incorporated into the pore portion and clearance portion of the filler and it is therefore necessary to increase the amount of the water-soluble cationic organic material to obtain the same effect that is produced using a treating agent containing no filler. However, if the amount is increased, the distribution of the water-soluble cationic organic material in the ink receiving layer tends to become denser on the surface than as required, easily causing the ink receiving layer to be decreased in water-resistance and in abrasion resistance in a wet condition and the print portion to be decreased in water-resistance and in abrasive resistance in a wet condition. Further, if both the binder and the filler are added together, a part of the water-soluble cationic organic material is incorporated into the binder portion and filler pore portion and it is therefore necessary to increase the amount of the water-soluble cationic organic material. However, if the amount is increased, the distribution of the water-soluble cationic organic material in the ink receiving layer tends to become denser on the surface than as required, easily causing the ink receiving layer to be decreased in water-resistance and in abrasion resistance in a wet condition and the print portion to be decreased in water-resistance and in abrasive resistance in a wet condition. Also, if the binder is cured with the water-soluble cationic organic material being contained therein, the water resistance tends to be reduced, with the result that a reduction in the water-resistance of the ink receiving layer is easily caused. When the binder is, particularly, polyvinyl alcohol, the water-resistance is significantly decreased.

Also, the layer containing the porous filler and the binder is formed by applying the coating liquid, followed by drying. For the drying of the layer, a usual method such as non-air drying, oven or hair drier may be used. Preferable drying temperature is about 100 to 120° C.

If an alumina sol is added as the hydrate aluminum oxide to raise the water-resistance of the ink receiving layer, a desirable effect is obtained. The content of the alumina sol to be added to the binder resin is 0.5 to 30% by weight and preferably 1.0 to 20% by weight. When the amount is less than 0.5% by weight, only insufficient effect is obtained whereas when the amount exceeds 30% by weight, the effect saturates and not only a further improvement is not obtained but also the ink receiving layer is easily curled.

Also, if a water-soluble aluminum salt is added to the ink receiving layer with the intention of allowing ink to have proper blurring ability and heightening developed color density, more desirable effect is obtained. Examples of the water-soluble aluminum salt include aluminum salts such as aluminum chloride, aluminum sulfate, aluminum nitrate, basic aluminum lactate or its analogues. Basic aluminum lactate, aluminum sulfate, ammonium aluminum sulfate and sodium aluminum sulfate are preferable in view of, particularly, color-developing ability.

The ratio by weight of the water-soluble aluminum salt to the porous filler is 1:200 to 1:10 and preferably 1:150 to 1:20. If the ratio of the water-soluble aluminum salt is higher than the above range (1:200 to 1:10), the ink-absorbing speed is low with the result that blurring is easily caused. On the other hand, excessively lower ratio causes the reflecting density to be decreased easily.

EXAMPLE

Next, examples according to the present invention and comparative examples will be explained.

As substrates to be used in examples and comparative examples, synthetic paper (YUPO FPG#80, manufactured by Oji Yuka Synthetic Paper Co., Ltd.) with a thickness of 80 μm was used. As polyvinyl alcohol (PVA) in a coating layer, five types shown in Table 1 below were respectively used. Polyvinyl alcohols (R-1130 and R-2105, manufactured by Kuraray Co., Ltd.) of samples 1 and 2 in Table 1 are silanol-modified polyvinyl alcohols.

Also, in anchor coating treatment, a material having the following composition was used in both examples and comparative examples.

TABLE 1

| (Composition of anchor coating) | |
|---|---|
| Acrylic resin (Acronal YJ-6221D, solid content: 49%, manufactured by BASF Dispersions Co., Ltd.) | 60.0 g |
| Water | 26.0 g |
| Calcium carbonate | 10.0 g |

Examples 1 to 5

A coating liquid having the following composition excluding a cationic organic material was applied to the surface of the above substrate after the above anchor coating treatment was carried out to form a coating layer with a coating thickness of 35 μm. In the coating liquid having the following composition, polyvinyl alcohol of the sample 1 in Table 1 was used in Example 1, and, in the same manner, polyvinyl alcohols of the samples 2, 3, 4 and 5 in Table 1 were used in Examples 2, 3, 4 and 5 respectively.

| (Composition of a coating liquid) | |
|---|---|
| Polyvinyl alcohol (samples 1 to 5) | 9.0 g |
| Water | 10.0 g |
| Nonionic surfactant (SN Deformer 480, manufactured by San Nopco Ltd.) | 0.3 g |
| Fluorescent bleaching agent (Brankphor BSU-PN liquid, manufactured by Bier AG) | 0.5 g |
| Hydrate aluminum oxide (Alumina sol 200, solid content: 10%, manufactured by Nissan Chemical Industries, Ltd.) | 18.0 g |
| Synthetic silica (Mizukasil P-78F, average particle diameter: 12.5 μm, oil absorptiveness: 230 ml/100 g, manufactured by Mizusawa Industrial Chemicals, Ltd.) | 20.0 g |

Each coating layer formed in the above manner was processed using the following surface processing solution for introducing a cationic organic material in an amount of 0.5 g/m$^2$ as solid content and 3.6% by weight based on the total solid weight to form an ink receiving layer, thereby preparing ink jet recording sheets of Examples 1 to 5.

| (Composition of a surface processing solution) | |
|---|---|
| Water | 90.0 g |
| Cationic organic material (dicyandiamide condensate NEOFIX E-117, solid content: 50%, manufactured by Nikka Chemical Co., Ltd.) | 6.0 g |

Example 6

A coating liquid having the following composition excluding a cationic organic material was applied to the surface of the above substrate after the above anchor coating treatment was carried out to form a coating layer with a coating thickness of 35 μm.

| (Composition of a coating liquid) | |
|---|---|
| Polyvinyl alcohol (the sample 1 in Table 1 was used) | 9.0 g |
| Nonionic surfactant (SN Deformer 480, manufactured by San Nopco Ltd.) | 0.3 g |
| Fluorescent bleaching agent (Brankphor BSU-PN liquid, manufactured by Bier AG) | 0.5 g |
| Hydrate aluminum oxide (Alumina sol 200, solid content: 10%, manufactured by Nissan Chemical Industries, Ltd.) | 14.0 g |
| Synthetic silica (SYLYSIA 440, average particle diameter: 3.5 μm, oil absorptiveness: 210 ml/100 g, manufactured by Fuji Silysia Chemical Ltd.) | 20.0 g |

The coating layer formed in the above manner was processed using the aforementioned surface processing solution for introducing a cationic organic material in an amount of 0.5 g/m$^2$ as solid content and 3.6% by weight based on the total solid weight to form an ink receiving layer, thereby preparing an ink jet recording sheet of Example 6.

Example 7

A coating liquid having the following composition excluding a cationic organic material was applied to the surface of the above substrate after the above anchor coating treatment was carried out to form a coating layer with a coating thickness of 35 μm.

| (Composition of a coating liquid) | |
|---|---|
| Polyvinyl alcohol (the sample 1 in Table 1 was used) | 9.0 g |
| Nonionic surfactant (SN Deformer 430, manufactured by San Nopco Ltd.) | 0.3 g |
| Fluorescent bleaching agent (Brankphor BSU-PN liquid, manufactured by Bier) | 0.5 g |
| Hydrate aluminum oxide (Alumina sol 200, solid content: 10%, manufactured by Nissan Chemical Industries, Ltd.) | 14.0 g |
| Synthetic silica (SYLYSIA 440, average particle diameter: 3.5 μm, oil absorptiveness: 210 ml/100 g, manufactured by Fuji Silysia Chemical Ltd.) | 9.5 g |
| Synthetic silica (Mizukasil P-78F, average particle diameter: 12.5 μm, oil absorptiveness: 230 ml/100 g, manufactured by Mizusawa Industrial Chemicals, Ltd.) | 6.0 g |
| Basic aluminum lactate (Takiceram M160-L, solid content: 10%, manufactured by Taki Chemical Co., Ltd.) | 1.5 g |

The coating layer formed in the above manner was processed using the aforementioned surface processing solution for introducing a cationic organic material in an amount of 0.5 g/m$^2$ as solid content and 3.6% by weight based on the total solid weight to form an ink receiving layer, thereby preparing an ink jet recording sheet of Example 7.

Example 8

A minute amount of sulfuric acid was added to the coating liquid of Example 7 to adjust the pH to 4 or less. Also, the treatment using the surface processing solution in Example 7 was changed such that the amount of the cationic organic material to be introduced was altered to 1.6% as solid weight based on the total solid weight of the ink receiving layer. The same procedures as in Example 7 were carried out except for the above alteration to obtain an ink jet recording sheet.

Comparative Examples 1 to 5

A coating liquid having the following composition including a cationic organic material was applied to the surface of the above substrate after the above anchor coating treatment was carried out to form a coating layer with a coating thickness of 35 μm, thereby obtaining ink jet recording sheets of Comparative Examples 1 to 5. The content of the cationic organic material was 11% by weight based on the total solid content.

In the coating liquid having the following composition, like the above Examples, polyvinyl alcohol of the sample 1 in Table 1 was used in Comparative Example 1, and, in the same manner, polyvinyl alcohols of the samples 2, 3, 4 and 5 in Table 1 were used in Comparative Examples 2, 3, 4 and 5 respectively.

| (Comparative Example 6) (Composition of a coating liquid) | |
|---|---|
| Polyvinyl alcohol (samples 1 to 5) | 9.0 g |
| Water | 10.0 g |
| Nonionic surfactant (SN Deformer 480, manufactured by San Nopco Ltd.) | 0.3 g |
| Fluorescent bleaching agent (Brankphor BSU-PN liquid, manufactured by Bier AG) | 0.5 g |
| Hydrate aluminum oxide (Alumina sol 200, solid content: 10%, manufactured by Nissan Chemical Industries, Ltd.) | 18.0 g |
| Cationic organic material (dicyandiamide condensate NEOFIX E-117, solid content: 50%, manufactured by Nikka Chemical Co., Ltd.) | 8.0 g |
| Synthetic silica (Mizukasil P-78F, average particle diameter: 12.5 μm, oil absorptiveness: 230 ml/100 g, manufactured by Mizusawa Industrial Chemicals, Ltd.) | 20.0 g |

Comparative Example 6 was prepared by carrying out no surface treatment in Example 1.

The ink jet recording sheets prepared in the above Examples and Comparative Examples were evaluated for "white paper portion abrasion water-resistance and "print portion abrasion water-resistance", "color developing ability" and "blurring" when used in an ink jet printer (JV-1300, manufactured by Mimaki Engineering Co., Ltd.) according to the following standards.

In the measurement of the white paper portion abrasion water-resistance, a white paper portion was abraded by a sufficiently wetted cotton swab under a load of 100 g until the ink receiving layer and the coating layer were peeled off, to count the number of times of going and returning (one way: about 50 mm).

As to the color-developing ability, cyan, magenta, yellow and black reflecting densities were measured using a Macbeth densitometer RD-918. The case where sufficient reflecting density was obtained was rated as "○", the case where the reflecting density was slightly lower was rated as "Δ" and the case where the reflecting density was insufficient was rated as "X".

The blurring was evaluated by visual observation. The case where no blurring was observed was rated as "○", the case where slight blurring was observed was rated as "Δ" and the case where heavy blurring was observed was rated as "X".

The results of the above evaluations were as shown in Table 2.

[Table 2]

As shown in Table 2, the ink jet recording sheets such as those prepared in Comparative Examples 1 to 5 which are made to contain the cationic organic material in the amount required to satisfy the color-developing ability and blurring characteristics in advance are considerably reduced in the white paper portion abrasion water-resistance. Also, in the case of the ink jet recording sheet such as that obtained in Comparative Example 6 containing no cationic organic material at all, the color-developing ability and the blurring characteristics are greatly impaired.

Contrary to the above Comparative Examples, the ink jet recording sheets of Examples 1 to 8 according to the present invention which are prepared by applying the cationic organic material after the layer which does not contain the cationic organic material is formed in advance is superior in the white paper portion abrasion water-resistance while maintaining high color-developing ability and excellent blurring characteristics. Particularly, when the binder is silanol-modified polyvinyl alcohol and also this silanol-modified polyvinyl alcohol has a saponification degree of 98% or more and a polymerization degree of 1000 or more, a large effect is obtained.

The present invention is as outlined above. The ink jet recording sheet of the present invention gives rise to no blurring of an image, has excellent color-developing ability and ink-fixing ability, is provided with an ink receiving layer and a print portion having high water-resistance and excellent abrasive resistance in a wet condition and also has excellent color reproducibility and light resistance. The ink jet recording sheet of the present invention has a very higher level performance than current ink jet recording sheets.

TABLE 1

| Sample | Company name | Product name | Degree of saponification | Degree of polymerization |
|---|---|---|---|---|
| 1 | Kuraray | R-1130 | 98.0-99.0 | 1700 |
| 2 | Kuraray | R-2105 | 98.0-99.0 | 500 |
| 3 | Kuraray | 124 | 98.0-99.0 | 2450 |
| 4 | Shinetsu Poval | C-25GP | 98.0 or more | 2600 |
| 5 | Unitika | UF250G | 99.0 or more | 2500 |

TABLE 2

| | White paper portion abrasion water-resistance: (time) | Color developing ability | Blurring characteristics |
|---|---|---|---|
| Example 1 | 34 | ○ | ○ |
| Example 2 | 11 | ○ | ○ |
| Example 3 | 8 | ○ | ○ |
| Example 4 | 10 | ○ | ○ |
| Example 5 | 15 | ○ | ○ |
| Example 6 | 100 or more | ○ | ○ |
| Example 7 | 85 | ○ | ○ |

TABLE 2-continued

| | White paper portion abrasion water-resistance: (time) | Color developing ability | Blurring characteristics |
|---|---|---|---|
| Example 8 | 95 | ○ | ○ |
| Comparative example 1 | 6 | ○ | ○ |
| Comparative example 2 | 4 | ○ | ○ |
| Comparative example 3 | 1 | ○ | ○ |
| Comparative example 4 | 1 | ○ | ○ |
| Comparative example 5 | 1 | ○ | ○ |
| Comparative example 6 | 34 | X | X |

What is claimed is:

1. An ink jet recording sheet, comprising a substrate;

a coating provided on the substrate, wherein the coating is formed by coating the substrate with a coating liquid containing a porous filler containing a first silica having an average diameter of 5 $\mu$m or less and a second silica having an average diameter of 10 $\mu$m or more, and a binder, the coating liquid having a pH of 4 or less, followed by drying the coating liquid; and a water-soluble cationic organic material impregnated into the coating, wherein the coating impregnated with the water-soluble cationic organic material forms an ink receiving layer, wherein the water-soluble cationic organic material is not present in the binder, wherein the water-soluble cationic organic material is impregnated in the ink receiving layer in an amount of 1.5 to 2.0% by weight, in terms of solid ratio of the ink receiving layer; and wherein the first filler and the second filler are contained in an amount of 40 to 80% by weight, in terms of solid ratio of the ink receiving layer.

2. An ink jet recording sheet according to claim 1, wherein a silanol-modified polyvinyl alcohol is contained as the binder.

3. An ink jet recording sheet according to claim 1, wherein the water-soluble cationic organic material is a dicyandiamide condensate.

4. An ink jet recording sheet according to claim 1, wherein the ink receiving layer contains a hydrate aluminum oxide.

5. An ink jet recording sheet according to claim 1, wherein the ink receiving layer contains a water-soluble aluminum salt.

* * * * *